US006621254B1

(12) United States Patent
Williams

(10) Patent No.: US 6,621,254 B1
(45) Date of Patent: Sep. 16, 2003

(54) AC VOLTAGE TRIAC REGULATOR

(76) Inventor: Darrell Allen Williams, 520 Pine, #41, Goleta, CA (US) 93117

( * ) Notice: Subject to any disclaimer, the term of this patent is extended or adjusted under 35 U.S.C. 154(b) by 0 days.

(21) Appl. No.: 10/119,363

(22) Filed: Apr. 9, 2002

(51) Int. Cl.[7] ..... G05F 1/10

(52) U.S. Cl. ..... 323/239; 323/237; 323/246; 323/300

(58) Field of Search ..... 323/234, 299, 323/300, 237, 239, 246; 327/451, 455

(56) References Cited

U.S. PATENT DOCUMENTS

| | | | | | |
|---|---|---|---|---|---|
| 3,299,276 | A | | 1/1967 | Buell et al. | 307/34 |
| 3,676,768 | A | | 7/1972 | Morrey | 323/22 T |
| 3,890,562 | A | * | 6/1975 | West | 323/235 |
| 4,178,539 | A | | 12/1979 | Crapo | 323/45 |
| 4,590,363 | A | * | 5/1986 | Bernard | 219/497 |
| 4,658,346 | A | | 4/1987 | Templeton | 363/160 |
| 4,733,158 | A | | 3/1988 | Marchione et al. | 323/258 |
| 4,860,145 | A | | 8/1989 | Klingbiel | 361/18 |
| 5,075,617 | A | | 12/1991 | Farr | 323/258 |
| 5,289,110 | A | | 2/1994 | Slevinsky | 323/301 |
| 5,450,002 | A | | 9/1995 | Dunk | 323/257 |
| 5,539,632 | A | | 7/1996 | Marsh | 363/155 |
| 5,550,459 | A | | 8/1996 | Laplace | 323/255 |
| 5,747,973 | A | * | 5/1998 | Robitaille et al. | 323/239 |
| 5,821,716 | A | | 10/1998 | Okanik | 318/478 |
| 5,825,164 | A | | 10/1998 | Williams | 323/255 |
| 6,100,673 | A | | 8/2000 | Bair, III et al. | 323/255 |
| 6,188,182 | B1 | | 2/2001 | Nickols et al. | 315/294 |

* cited by examiner

*Primary Examiner*—Shawn Riley
(74) *Attorney, Agent, or Firm*—Head, Johnson and Kachigian

(57) ABSTRACT

A method of providing a regulated AC output voltage at a predetermined level that makes use of an AC input voltage having a higher level, includes the steps of rectifying the input voltage to provide a DC input reference voltage, rectifying the output voltage to provide a DC output reference voltage, comparing the DC output reference voltage to the DC input reference voltage to provide a comparator signal, providing a triac circuit connected to the AC input voltage that supplies the AC output voltage and using the comparator signal to control the triac circuit.

4 Claims, 2 Drawing Sheets

AC VOLTAGE TRIAC REGULATOR

CROSS-REFERENCE TO RELATED APPLICATIONS

This application is not related to any pending United States or international patent application.

REFERENCE TO MICROFICHE APPENDIX

This application is not referenced in any Microfiche Appendix.

1. Field of the Invention

This invention relates solid state electronic apparatus, and particularly to a solid state circuit for providing a pre-selected low AC voltage output from a variable AC voltage input. The invention is particularly adapted for control of low voltage lighting circuits.

2. Background of the Invention

In many applications of electronic circuits, it is important to provide a pre-selected AC voltage output that is independent of an AC voltage input. Most particularly, IT is important to be able to provide a pre-selected AC voltage output from an AC voltage input employing only solid state, inexpensive, dependable, and readily available circuit components.

The invention herein is applicable to any installation in which a pre-determined regulated AC output voltage is required when a variable AC input voltage is available and wherein the input voltage always exceeds the desired output voltage. The invention is particularly useful in low voltage wiring. A typical application of low voltage wiring is in landscaped lighting, such as the provision of lights along a sidewalk, a driveway, a flower bed, or to highlight statuary, shrubbery, or the like. Such landscape lighting can be installed by home owners, or by professional installers. For this reason, the electrical codes of many municipalities allow non-licensed electricians to install low voltage lighting so as to alleviate the expense of employing licensed electrical contractors to do such work. The rationale for permitting home owners to install their own low voltage lighting is that the voltage is such that the possibility of receiving a lethal, a harmful, or even a painful electric shock is substantially eliminated. Thus, if a home owner that is inexperienced with installing electrical wiring elects to install his own low voltage wiring system, he can do so with safety since the voltage that is transmitted to the wiring apparatus is typically below 15 volts, and further typically employs circuitry with nominal maximum amperage so that the possibility of causing a fire or an injurious exposure to electricity is substantially non-existence.

One of the problems encountered in low voltage wiring is that of maintaining a pre-selected AC voltage at different locations when distances from a household AC outlet can vary considerably. Typically, a low voltage wiring system consists of a transformer having a primary that is connectable to the typical household voltage, that is, in the United States, 110 volts. The transformer serves to step the voltage down so that the voltage output is at a relatively low voltage, such as a maximum of 15 volts or similar low voltages according to electrical code requirements. This low voltage, such as 15 volts, is then fed to lighting fixtures. Some of the lighting fixtures may be relatively close to the transformer so that very little voltage drop occurs between the transformer and the energy consuming light fixture. On the other hand, some of the outdoor lights may be at a substantial distance, such as several hundred feet from the transformer that supplies the low voltage. The use of low voltage mandates greater current flow in order to illuminate electric bulbs of typical wattages, that is, the current in a low voltage wiring system is usually substantially greater than the current that would be required if the lighting was all powered by standard household voltage. High current flow causes rapid voltage drops through wiring required to reach lighting fixtures at a distance. For this reason, it is very helpful if means can be provided so that a variety of light fixtures or circuits extending to light fixtures, spaced at a distance from an AC input source can be operated in such a way that substantially the same voltage appears across each light bulb irrespective of its distance from the initial voltage source.

Accordingly, one of the objectives of the present invention is to provide a solid state device for producing a predetermined AC voltage output, irrespective (within limits) of the AC voltage input. By the expression "irrespective of AC voltage input" means that the AC voltage input cannot vary indefinitely. In a preferred practice of the invention, the input voltage is slightly (within a few volts) above the desired output voltage. The regulator of this invention then provides a slightly reduced, but predetermined output voltage wherein the reduced output voltage is that which is preferred for operating light fixtures or other load consuming devices.

CROSS-REFERENCE RELATED TO PRIOR ART

For reference to previously issued patents relating to systems for providing low voltage wiring and for assistance in providing solid state voltage regulators, reference may be had to the following previously issued United States patents:

| NT NO. | FILED | INVENTOR | TITLE |
|---|---|---|---|
| 3299276 | 01/17/67 | H.R. Buell, et al. | Transistorized Multiple Voltage Regulation System |
| 3676768 | 07/11/72 | Morrey | Source Independent Power Supply |
| 4178539 | 12/11/79 | Crapo | Stepping AC Line Voltage Regulator |
| 4658346 | 04/14/87 | Templeton | Apparatus for Co-Generation of Electric Power |
| 4733158 | 03/22/88 | Marchione et al. | Control Circuit for Tap-Switching Power Supplies and Multi-Tap Transformers |
| 4860145 | 08/22/89 | Klingbiel | Tap Switching Protection Circuit |
| 5075617 | 12/24/91 | Farr | Automatic Line Drop Compensator |
| 5289110 | 02/22/94 | Slevinsky | Input Current Responsive, Tap Changing Transformer System |
| 5450002 | 09/12/95 | Dunk | Co-Controller for Controlling an LTC Transformer with a Standard Voltage Regulator Control |
| 5539632 | 07/23/96 | Marsh | Multi-Phase and Shifted Phase Power Distribution Systems |
| 5550459 | 08/27/96 | Laplace | Tap Position Determination Based on Regular Impedance Characteristics |
| 5825164 | 10/20/98 | Williams | Inductance Controller with Load Regulator |
| 6100673 | 08/08/00 | Bair, III et al. | Voltage Control Device for Increasing or Decreasing Voltage to a Load |
| 6188182 B1 | 02/13/01 | Nickols et al. | Power Control Apparatus for Lighting Systems |

BRIEF DESCRIPTION OF THE INVENTION

This invention herein provides a circuit having an AC input such as an input of approximately 15 volts to provide a preselected output voltage of, as an example, 12 volts. The United States is 120 volts AC voltage down to a substantially lower but preselected voltage, such as 24 volts AC.

The invention herein provides a preselected output voltage equal to or less than an input voltage. As an example of the application of the invention to low voltage lighting, the system may use, as an example, a transformer that reduces household current from the typical 110 volts AC to 15 volts AC. Bulbs employed in a lighting system may be designed to operate efficiently at 12 volts AC. In a lighting circuit, voltage drops always occurs between the AC input circuit and light bulbs in various distances from the voltage source. However, it is important that the voltage supplied to the various bulbs employed in a wiring circuit be as near as possible to the same voltage, such as 12 volts. Thus, circuits having light bulbs close to the voltage source may be the same as the input voltage, such as 15 volts. However, in a location at a farther distance from the source, the voltage may drop to 14 volts. Farther away from the voltage source, the voltage may drop to, as an example, 13 volts due to $I^2R$ loss because of the length of the wiring. However, the voltage to the bulbs needs to be at or close to 12 volts.

The solid state voltage regulator of this invention can be used at a plurality of locations at various distances from an AC source, and therefore, at distances wherein the $I^2R$ drop reduces the available voltage at the point of a circuit in a manner that, nevertheless, all points in the circuit have available for illumination of bulbs a preselected standardized voltage, such as 12 volts. As previously indicated, the application of this invention to low voltage wiring is merely an example. The invention is in no wise limited to this specific application.

A more complete understanding of the invention will be obtained from the following specification of the preferred embodiment, taken in conjunction with the attached drawings and the claims.

DESCRIPTION OF THE DRAWINGS

FIG. 3 shows that the voltage regulator of this invention functions by cutting off portions of the input voltage wave form to provide an output wave form having a preselected reduced voltage determined by the root means square of the output wave form.

DETAILED DESCRIPTION OF A PREFERRED EMBODIMENT

Figure 1:
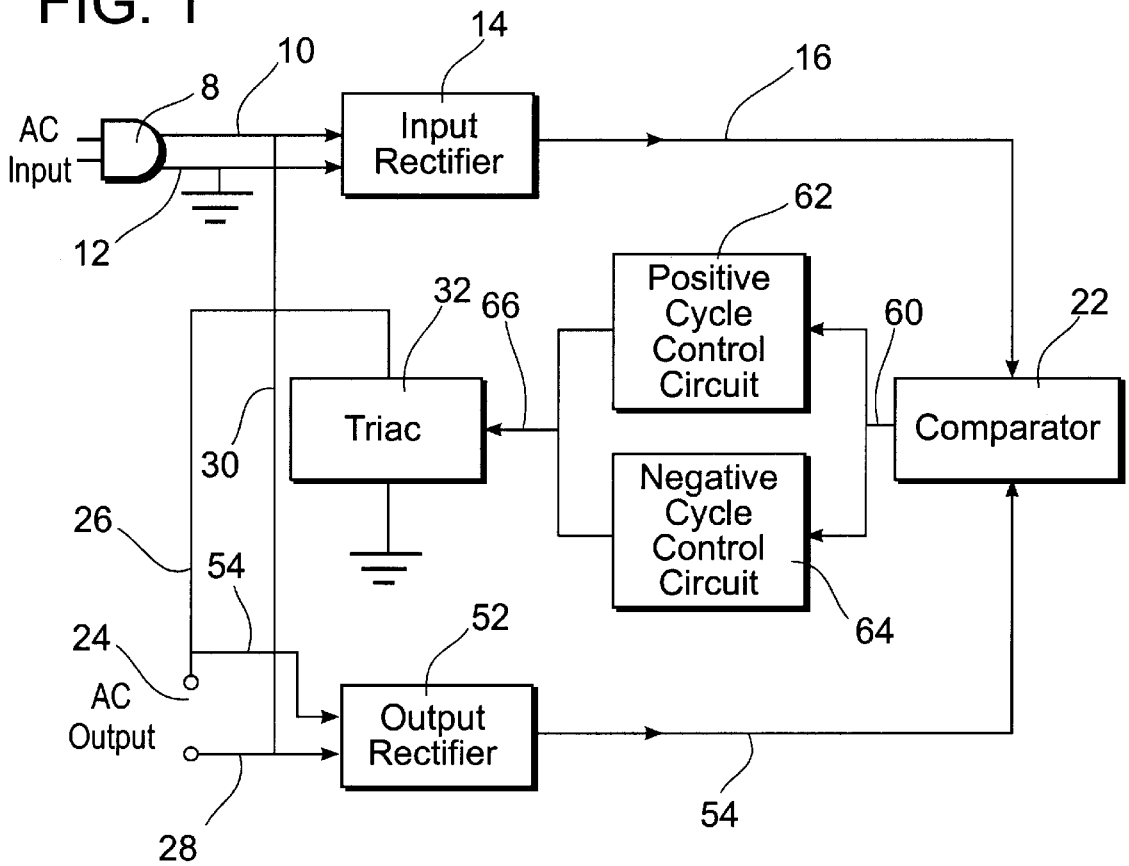
FIG. 1 is a block diagram showing the basic concept of a circuit that incorporates the principle of this invention to provide a solid state voltage regulator that employs a variable AC input voltage and provides a preselected reduced AC voltage output.

Referring first to FIG. 1, a block diagram shows the basic principles of this invention. An AC voltage input conductor is indicated at 10. This input will typically be obtained from the secondary of a transformer (not shown) wherein the primary of the transformer is in communication with a typical household AC voltage supply. In the United States the typical household voltage is approximately 110 volts AC. The transformer reduces this voltage down to a substantially reduced low AC voltage of, as an example, approximately 15 volts AC.

Thus, in a typical application of the invention, the AC voltage input provided across conductors 12, is as an example, 15 volts. One pole of the 15 volt AC is shown as connected to ground. The opposite pole of the input is connected to an input rectifier 14 that provides a rectified DC output on conductor 16. That is, there appears at the output on conductor 16 of input rectifier 14 a DC reference voltage that is a preselected DC value, such as 5 volts DC, that is independent of the input voltage. This preselected DC reference voltage is applied to a comparator circuit 22.

An AC output is provided at 24 on conductors 26 and 28. Conductor 28 is connected by conductor 30 to input conductor 10, that is, the voltage appearing at conductor 28 is the same as that on input conductor 10. However the voltage measured at AC output 24 is not the same as the voltage at an input voltage 8 since conductor 28 is not referenced to a permanent ground. Instead, a triac 32 is used to control voltage to AC output 24 in a way so that the output voltage is at a preselected, reduced voltage. Triac 32 functions to turn on and off the input voltage wave form in a manner as illustrated in FIG. 3.

Figure 3:
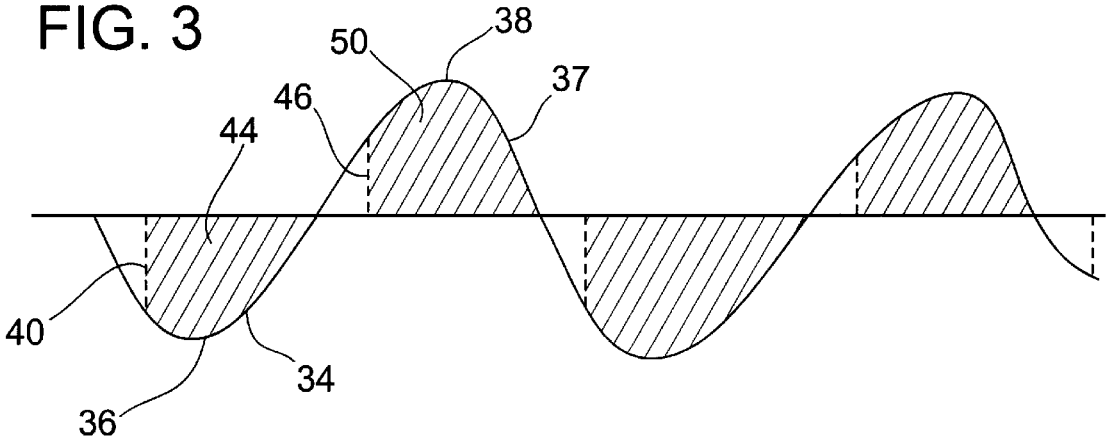
FIG. 3 is a graph showing an AC voltage as supplied to the input of the voltage regulator of this invention and showing cross-hatched the resultant voltage output wherein the voltage output has a preselected RMS voltage level.

In FIG. 3, an input voltage wave form is indicated by the numeral 34. The input voltage wave form 34 varies as typical of an AC voltage as a sine wave that moves above and below zero voltage, that is, is has a positive half cycle and a negative half cycle. The invention herein provides a circuit that controls triac 32 so that on both the positive and negative half cycles, the voltage appearing at AC output 24 is turned on in a delayed manner for each half cylinder. That is, the voltage appearing at AC output 24 is less than a full half wave on both the positive and negative portions of a cycle. As seen in FIG. 3, the first negative half cycle shows the input voltage wave form 34 passing from zero to a maximum or peak voltage at 36 and then back to zero and then passing to a positive maximum or peak voltage at 38 and back to zero. The circuit of this invention turns the triac 32 on at 40 (as seen in FIG. 3) so that the energy or wattage supplied for the first negative half cycle is that indicated by a cross-hatched portion 44 of the input voltage wave form 34. In a like manner, on the positive cycle, conductor 26 feeding AC output 24 is connected to ground in a manner that is delayed to the point indicated by 46, that is, the voltage is turned on at 46 so thereby the electrical energy or wattage supplied by AC output 24 during the positive half cycle is represented by a shaded area 50. The total AC wattage transmitted to output 24 is the root means square of the output AC signal, that is, the cross-hatched portion 44 and the shaded area 50 of the input voltage cycle. It is noted that the circuit does not significantly reduce the peak voltages, that is, the peak voltage at 36 of the negative half cycle and the peak voltage 38 of the positive half cycle remain essentially the same as the input voltage at 8. However, the effective wattage applied to illuminate lights in a circuit is reduced because the wave form is changed by delayed turning on and off the voltage on each negative and each positive half cycle.

The essence of this invention is a means of turning on and off an input AC voltage to reduce the root means square value of the output voltage to a preselected level. The amount of delay in turning on the voltage for each half cycle and the corresponding time in which the voltage is turned off of each half cycle, is the mechanism by which the reduced preselected AC voltage output is obtained. That is the essence of this invention.

As shown in FIG. 1, an output rectifier 52 is used to rectify the AC output voltage appearing at 24 to provide a DC output reference voltage. This DC output reference voltage is fed by conductor 54 to comparator circuit 22. Thus, comparator circuit 22 compares the input reference voltage from input rectifier 14 to the output reference voltage from output rectifier 52. The circuit herein then utilizes this comparison to provide a signal to control triac 32 so that the triac 32 is turned on as to control the AC output voltage appearing at 24. As an example, if the output DC voltage appearing at conductor 54 indicated that the AC output voltage at 24 needs to be increased, the circuit increases the amount of time for each half cycle that triac 32 is turned on. On the other hand, if the reference voltage at 54 indicates that the output AC voltage at 24 is greater than desired, the comparator circuit 22 provides a signal at its output 60 that is employed by the circuit to decrease the amount of time that triac 32 conducts. By increasing the amount of time triac 32 is conducting, as will be understood by referenced FIG. 3, the volume of cross-hatched portion 44 for each negative half cycle and the volume of shaded area 50 for each positive half cycle will increase, thereby increasing the AC output voltage at 24. However, if the triac 32 is operated in such a way, as controlled by the comparator's output signal at 60, that the cross-hatched portion and the shaded area 50 decrease so that the result of RMS output voltage at 24 decreases.

The circuit used to control triac 32 consists essentially of a positive cycle control circuit 62 and a negative cycle control circuit 64. Both the negative and positive cycle control circuits 64 and 62 respond to the output signal at 60 provided by the comparator circuit 22 to provide a signal at conductor 66 that controls the gate of triac 32 to switch it on or off as required to maintain the AC output voltage at 24 at the preselected level.

Figure 2:
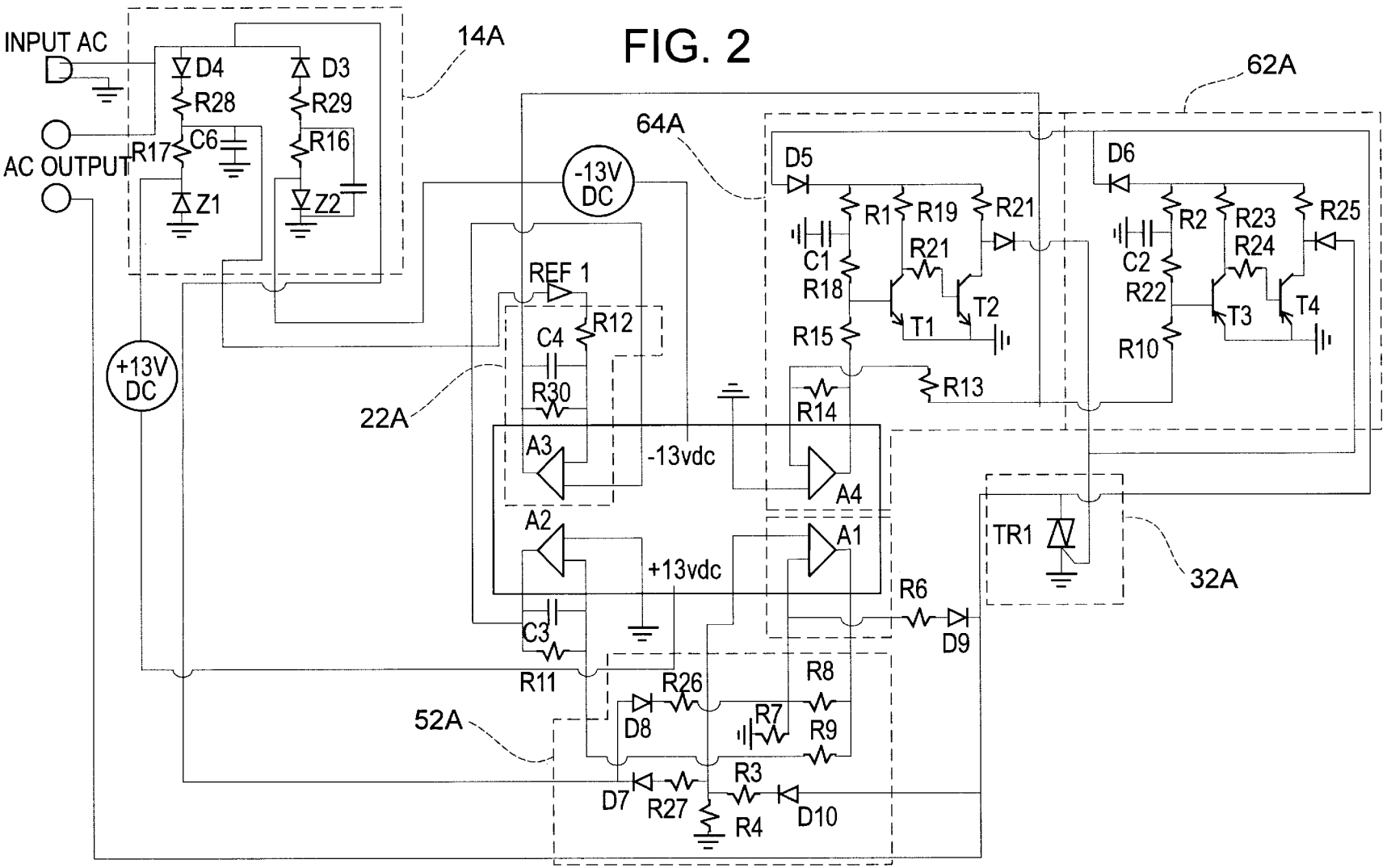
FIG. 2 is a circuit showing one embodiment of the principles of the invention.

FIG. 2 shows an embodiment of a circuit that can be used to practice the principles of this invention as illustrated in FIG. 1 and 3. In this circuit, capacitors are identified with the letter "C", resistors by the letter "R", diodes by the letter "D", amplifiers by the letter "A", transistors by the letter "T", and zeners by the letter "Z". The basic portions of the circuit of FIG. 2 that provide the functions as illustrated in FIG. 1 are enclosed in a dotted outline. Thus, the basic components of input rectifier 14 of FIG. 1 are indicated by 14A in FIG. 2. In like manner, the elements making up the negative cycle control circuit 64 is indicated by 64 A; the positive cycle control circuit 62 by the elements indicated by 62A; the triac by 32A; and the output rectifier 52 by components 52A; the comparator circuit 22 by components 22A.

In summary, the circuit employs triac 32 for voltage control. The circuit delays firing the triac on both the positive and negative swings of the input voltage until the remaining portion of the voltage wave form equals the required voltage at AC output 24. In FIG. 2 diodes D7, D8, D9, and D10, resistors R4, R7, R26, R27, R6, R3, and R8, and amplifier A1 form a circuit which the output voltage and references that voltage to AC ground. The circuit composed of capacitor C3, resistors R9, R11, and amplifier A2 integrates the rectified voltage into a DC voltage proportional to the AC voltage outlet. This voltage reference is compared to the integrated voltage by a circuit composed of resistor R12 and R30, capacitor C4, and amplifier A3 which forms comparator circuit 22 of FIG. 1. The output of that comparator circuit 22 becomes a positive voltage which through R10 biases transistor T3 off until the capacitor C2 is charged through R2 to a negative enough voltage to overcome that bias and turn on T3. This turns off transistor T4 which allows triac 32 to be fired through resistor R25 and diode D1. The delay caused by the voltage on the output of A3 is what completes the loop and regulates the output. The output of A3 is inverted by the circuit composed of resistor R3, R4, and amplifier A4. The output of A4 through resistor R15 delays the firing of transistor T1 and delays the firing of the triac 32 on the positive portion of the cycle. In summary, the circuit chops off the leading part of the AC sine wave on both the positive and negative half cycles until the remainder equals the desired voltage out. Thus, the circuit functions by providing a closed loop generated by looking at the value of the output voltage.

The circuit diagram 52 is exemplary of a circuitry to provide the control functions as discussed in reference to FIG. 1 in which a DC voltage representative of the input voltage and a voltage representative of the output voltage are coupled to a comparator and the output of the comparator voltage used to delay the firing of a triac to provide a regulated AC voltage output irrespective of changes in the AC voltage input, as long as the AC voltage input is within a designated range. Representative valves and characteristics of the circuit of FIG. 1 are as follows:

R19, R20, R23, and R24—4.7 k ohms; R21, R25, and R12—200 k ohms; R16, R17, R28, and R29—100 ohms ¼ watt; R1, R2, R3, R6, R26, and R27—10 Kk ohms; R10 and R15—26 k ohms; R7 and R4—1.1 k ohms; R8—3.3 k ohms; R9—16 k ohms; R11—19 k ohms; R13, R14, and R30—33 k ohms; D1, D2, D3, D4, D7, D8, D9, and D10—switching diodes; Z1 and Z2—13 volt zeners; D5 and D6—gp diodes with <0.4 volts forward bias; C5 and C6—22 uf; C3—10 uf; C1, C2 and C4—iuf bi-polar; TRI (triac 32 )—4–30 amp; A1, A2, A3 and A4—low power rail to rail quad amp; T3 and T4—pnp switching transistors; and T1 and T2—npn switching transistors.

In FIG. 2, amplifiers A1, A2, A3 and A4 are shown as being in the form of quad amplifier chip.

Throughout the detailed description of the preferred embodiment, the abstract and the claims reference is made to a "triac". The term "triac" is used herein, including in the claims, to mean any solid state circuit or solid state components or device that accomplishes the same purpose as the readily available solid state device on the market at the time of this writing that is called a "triac". Stated another way, any solid state circuit or device that accomplishes the purpose of the device presently known as a "triac" is within the scope of this invention irrespective of the name by which is it is or maybe called.

The claims and the specification describe the invention presented and the terms that are employed in the claims draw their meaning from the use of such terms in the specification. The same terms employed in the prior art may be broader in meaning than specifically employed herein. Whenever there is a question between the broader definition of such terms used in the prior art and the more specific use of the terms herein, the more specific meaning is meant.

While the invention has been described with a certain degree of particularity, it is manifest that many changes may be made in the details of construction and the arrangement of components without departing from the spirit and scope of this disclosure. It is understood that the invention is not limited to the embodiments set forth herein for purposes of exemplification, but is to be limited only by the scope of the attached claim or claims, including the full range of equivalency to which each element thereof is entitled.

What is claimed:

1. A method of providing a single regulated AC output voltage at a predetermined level that makes use of a single AC input voltage having a higher level, comprising:

rectifying said single input voltage to provide a DC input reference voltage;

rectifying said single output voltage to provide a DC output reference voltage;

comparing said DC output reference voltage to said DC input reference voltage to provide a comparator signal;

providing a triac circuit connected to said single AC input voltage and that supplies said single AC output voltage; and using said comparator signal to control firing of said triac such that the single AC output voltage maintains a constant value that is less than the single AC input voltage.

2. A method of providing a regulated AC output according to claim 1 wherein said comparator signal separately controls the firing of said triac on each half cycle of said input voltage.

3. A method for receiving an AC input voltage at a variable AC level and providing a regulated AC output voltage of a predetermined reduced AC level comprising:

providing a triac to which the input AC voltage is subjected;

providing a first circuit that delays firing said triac on each positive cycle of said input voltage and thereby providing a remaining portion of said input voltage positive cycle;

providing a second circuit that delays firing said triac on each negative cycle of said input voltage and thereby provides remaining portion of said input voltage negative cycle, said remaining portions of said positive and negative cycles providing said AC output voltage; and comparing a DC voltage which represents the value of said AC input voltage with a DC voltage which represents the value of said AC output voltage to provide a control signal that controls said delays in firing said triac.

4. A method for providing regulated AC output voltage according to claim 3 wherein said step of providing said first circuit includes providing a first zener and diode combination to achieve a bias voltage that is applied to said triac to fire said triac on each said positive voltage cycle and a second zener and diode combination to fire said triac on each said negative voltage cycle.

* * * * *